United States Patent [19]

Sibille

[11] Patent Number: 4,972,741

[45] Date of Patent: Nov. 27, 1990

[54] ISOLATED TORSIONAL-TRANSFER COMBINED TONG APPARATUS

[75] Inventor: Mark S. Sibille, Lafayette, La.

[73] Assignee: Franks Casing Crew and Rental Tools, Inc., Lafayette, La.

[21] Appl. No.: 257,280

[22] Filed: Oct. 13, 1988

[51] Int. Cl.[5] ..... B25B 17/00

[52] U.S. Cl. ..... 81/57.16; 81/57.34

[58] Field of Search ..... 81/57.16 R, 57.15, 57.36, 81/57.34, 467, 57.24; 175/85, 77.5; 73/151

[56] References Cited

U.S. PATENT DOCUMENTS

| | | | |
|---|---|---|---|
| 1,386,345 | 8/1921 | McGowan et al. | 81/57.16 |
| 4,082,017 | 4/1978 | Eckel | 81/57.16 |
| 4,246,809 | 1/1981 | Keast et al. | 81/57.16 |

*Primary Examiner*—Frederick R. Schmidt
*Assistant Examiner*—Lawrence Cruz
*Attorney, Agent, or Firm*—Joseph L. Lemoine, Jr.

[57] ABSTRACT

An apparatus for making up and breaking out of pipe, bolts or other threaded members, and for measuring the amount of torque being applied to the threaded connection, without causing the application of undesirable transverse forces during the tightening or loosening process.

The apparatus includes a conventional power-driven lead tong, a back-up tong with a pivotal mounted inner frame which cooperates with a load cell, and an isolated torsional transfer structure which interconnects the lead tong and back-up tong through pairs of three mutually peripendicular linear slides. The load cell, pivotally mounted inner frame and external housing of the back-up tong cooperate to produce a torque measurement without creating any unpaired linear forces against the connection being made. The three mutually perpendicular slides of the interconnecting frame allow for the transferal of torque between the lead tong and back-up tong, so that their relative tendencies to rotate about the work piece in opposite direction is resisted, but the slides eliminate any net linear forces between tongs. By eliminating all unpaired linear forces arising out of the torque measuring process, and by eliminating all unpaired linear forces arising out of each tong resisting the other tong's tendency to rotate, threaded connections are tightened and loosened by pure torque alone, with no transverse or bending forces applied to the connection.

17 Claims, 8 Drawing Sheets

ISOLATED TORSIONAL-TRANSFER COMBINED TONG APPARATUS

BACKGROUND OF THE INVENTION

1. Field of the Invention

The invention relates to apparatus used for assembling or disassembling members having mating threaded connections, such as pipe joints, threaded rods and bolts. More particularly, the invention relates to improved means to interconnect power-driven lead tong and back-up tongs, commonly used to make-up and break-out tubular goods used in earth boreholes, particulary in oil and gas wells. Additionally the invention relates to improved means to measure the torque applied to a threaded member by said tong combination.

2. Description of Prior Art

In virtually every industrial field there is at least some requirement for assembling and disassembling members having mating threaded connections such as, pipe, rods and bolts. Perhaps the best known requirement for making-up (or breaking-out) of such members exists in the earth boring industry, particularly that involving exploration for, and production of, oil and gas wells. In the oil and gas field, depending on the phase of operations being conducted, miles of drill pipe, hole casing or production tubing are necessarily assembled at the surface on a piece-by-piece basis. Similarly, each time it becomes necessary to remove pipe, casing or tubing from the borehole (for bit changes, pipe repair, pipe salvage or many other reasons), the string of pipe is progressively lifted from the hole, and disassembled at the surface on a piece-by-piece basis.

Because of the need to repetively make and break threaded member connections, various apparatus, generally referred to as tongs, more specifically lead tongs and back-up tongs, have been developed to facilitate that task.

As deeper wells are drilled the weight of the pipe string increases, as does the internal and external pressures the pipe must bear, thus greater demands are placed on the pipe, particularly on its threaded connections. In deeper wells pipe joints are often tightened to a high, extremely critical torque. Too low a torque can lead to leakage of drilling fluids or even the flammable fluids being produced. Too high a torque can damage the pipe joints and result in leakage or even separation of the pipe string in the hole. It is readily apparent that replacement or repair of damaged pipe, sometimes not discovered until the pipe is set in the borehole, is time consuming, dangerous and expensive.

It is readily apparent that during assembly and disassembly of a threaded connection there is no requirement for transverse (or lateral) (normal to the pipe axis) forces to be applied to said connection and, in fact such forces can have serious detrimental effects. Frictional forces due to lateral forces cause false torque reading and can cause premature thread galling. Said lateral forces can actually bend the pipe. Application of lateral forces during tightening can also cause the connection to tighten off center, which can result in loss of the connection's fluid seal.

While much of the prior art addresses other problems regarding use of tongs to assemble and disassemble threaded connections, the problem of lateral stresses has, hitherto, not been solved.

Kelley, U.S. Pat. No. 3,545,313, Dec. 8, 1970, discloses a combined lead tong ("grapple") and back-up tong. The lead tong and back-up tong are movable relative to each other along the axis of the pipe and the back-up tong is slidable toward and away from that axis. Relative turning movement of either the lead tong or the back-up tong is prevented by use of a single, interconnecting, rearwardly disposed shaft and sleeve arrangement. As is readily apparent this means of interconnection induces lateral forces on pipe joint during tightening or loosening. No means is disclosed for measuring the torque these tongs apply to the pipe joint.

Weiner, U.S. Pat. No. 4091,451, May 23, 1978, disclosed a method and apparatus for calculating the torque being applied to a pipe joint and for counting the number of turns of one member relative to the other. The invention discloses, in essence, a means for early detection of a "bad joint" being caused by lateral forces being applied during tightening, which causes "bending of one of the threaded members relative to the other, such as when rotating pipe sways, creates a false indication of reference torque . . . ". This invention detects some of the problems caused by the application of lateral forces during tightening or loosening, but does not prevent the lateral forces from occurring.

True, U.S. Pat. No. 4,125,040 discloses an apparatus for automatically stopping the application of torque to a pipe joint when a predetermined value has been achieved. The sensing means described is a strain gauge in a snubbing line. With reference to FIG. 1(*a*) herein, as is readily apparent, use of a snubbing line to restrain tong rotation about the pipe induces lateral stresses on the pipe joint during tightening or loosening.

Peveto, U.S. Pat. No. 4,170,908, Oct. 16, 1979, discloses a combined lead tong and back-up tong which is improved by the addition of an automatic indexing mechanism which aligns openings of the frame after make-up or break-out of a pipe joint. Also, disclosed is a pair of fasteners disposed on each side of the tong for purpose of suspending the back-up tong from the lead tong. Though not discussed, it appears that the fasteners are somewhat slidable in the direction of the pipe axis and toward and away from the pipe axis. No third slide, perpendicular to the slide allowing movement toward and away from the pipe axis, is provided. Without such slide lateral forces would be imposed on the pipe connection during tightening or loosening.

Eckel, U.S. Pat. No. 4,290,304, Sept. 22, 1981, discloses a back-up tong improved by the addition of an apparatus which automatically releases the back-up tong if the drill pipe begins to slip down into the borehole or the tongs are lifted prematurely. Disclosed therein is a "stinger" rearwardly disposed on the back-up tong frame which cooperates with a load cell and the lead tong to produce a torque measurement. With reference to FIG. 1 and FIG. 2, said stinger, either cooperating with a snubbing line or with a "reaction bar" attached to the lead tong, would induce lateral stresses on the pipe during tightening or loosening.

Kinzback, U.S. Pat. No. 4,346,629, Aug. 31, 1982, discloses a lead tong for use in making-up and breaking-out of joints of varying diameter. No specific means of restraining tong movement about the pipe or measuring torque is disclosed.

Mooney, U.S. Pat. No. 4,402,239 discloses a combined lead tong and back-up tong which rearwardly cooperate with a load cell to produce a torque measurement. The back-up tong is suspended from the lead tong by a plurality of vertical shafts which cooperate with elongated apertures through the back-up tong to allow some relative rotational movement between the tongs. The disclosed means of interconnecting the tongs does not prevent lateral forces on the pipe joint, in fact the rearwardly disposed rigid cooperation between the lead tong and back-up tong (through a load cell) induces lateral forces on the pipe joint during tightening or loosening.

Reinholdt, U.S. Pat. No. 4,492,134, Jan. 8, 1985, discloses a combined lead tong and back-up tong slidably mounted to a platform. The lead tong and back-up are interconnected by a plurality of hydraulic cylinders each of which is movable in any direction in a horizontal plane, rotatably or linearly, against "resilient" support elements. This invention does not prevent lateral forces from being applied to the pipe joint during tightening or loosening, but attempts to "compensate" for "traverse relative movements, which cannot be completely prevented".

Shewmake, U.S. Pat. No. 4,494,425, Jan. 22, 1985, discloses a combined spinning tong and back-up tong having a slidable interconnection between the tongs, along the pipe axis, to allow the distance between the tongs to shorten or lengthen as the pipe joint shortens during assembly or lengthens during disassembly. The disclosed means of interconnection, comprising no traverse slides, does not prevent lateral forces on the pipe joint during tightening or loosening.

None of these patents disclose the present invention. In each of these patents the means used to "hold" the tongs "in place", that is, restrain them from rotating about the pipe axis during tightening or loosening, whether by snubbing lines or by the interconnecting means disclosed, produce lateral forces on the pipe joint during said torquing process. Some of the patents disclose means of detecting the undesirable effect of lateral forces and some attempt to "compensate" for some of the undesirable effects of lateral forces, but none are directed to preventing those forces from arising.

When a lead tong is operated, a rotary element contained within the tong body grasps a first threaded member. A motor, usually hydraulic, contained within the lead tong body generates a "driving torque" which is applied to the rotary element to rotate it, and the first threaded member therein, in the desired direction. By operation of Newton's third law of physics (that is, in essence, "for every force there exists an equal and opposite force"), creation of the "driving torque" (which is applied to the threaded member) results in a "reaction torque", which is applied to the lead tong body in the opposite direction. This reaction torque must be counteracted, to secure the lead tong body from spinning about the pipe rather than driving the pipe itself.

Hitherto, prior art means for securing the lead tong body against rotation about the pipe were by use of a snubbing line, a "reaction bracket" which rigidly cooperates with back-up tongs, or multiple members which rigidly (or resiliently) cooperate with the back-up tongs. All of these conventional means produce linear, laterally directed and unpaired force vectors on the lead tong body. The lead tong body tends to move laterally in response to said linear force vectors, which said lateral movement is resisted by the pipe. FIG. 1(*a*) diagrams the lateral force vectors when a prior art snubbing line was used to secure the lead tong body against movement about the pipe. FIG. 1(*b*) diagrams the lateral force vectors when a prior art "reaction bracket", cooperating with the back-up tong, was used to secure the lead tong body against movement about the pipe. FIG. 1(*c*) diagrams the prior art lateral force vectors when a prior art multiple rigid interconnects, cooperating with the back-up tong, was used to secure the lead tong body against movement about the pipe.

With reference to prior art back-up tongs, a similar phenomena occurred. Means used hitherto to secure back-up tongs from rotating with the pipe resulted in a lateral force being applied to the second threaded member (lower pipe). The lateral force vector applied to the second threaded member (lower pipe) was equal in magnitude, but opposite in direction to the lateral force induced by the lead tong above. A combination of the lateral force imposed on the upper pipe by the lead tong and on the lower pipe by the back-up tongs produced a bending moment across the pipe joint being tightened or loosened. FIG. 2(*a*) diagrams the lateral force vectors, created by both the lead tong and the back-up tong, when prior art snubbing lines were used. FIG. 2(*b*) diagrams the lateral force vectors created by both the lead tong and the back-up tong when a prior art "reaction bracket" was used. FIG. 2(*c*) diagrams the lateral force vector created by both the lead tong and back-up tong, when prior art multiple rigid (or resilient) interconnects were used.

As is readily apparent, the application of lateral forces on a pipe joint during tightening or loosening can have serious undesirable effects. Extra, and uneven, friction forces (see FIG. 3) caused by such side-loading can cause premature galling of the threads. The extra frictional forces can cause a false measurement which results in the joint being inadequately tightened. Further, the joint could "freeze" with a lateral displacement of the threads, which causes poor fluid sealing, or, if the lateral displacement later resolves, the joint may then be inadequately tightened.

The invention disclosed herein represents a vast improvement over prior art.

OBJECTS OF THE INVENTION

The general objects of this invention are to provide a new and improved tong apparatus for assembling and disassembling tubular goods (or solid cylindrical goods) having threaded connections.

More particularly, one object of the present invention is to interconnect the lead tongs and back-up tong so that their relative tendencies to rotate about the pipe axis, in opposite directions, counteract each other and therefore the combined, interconnected unit does not require external securing means such as snubbing lines.

Another object of the present invention is to provide a means of tong interconnection which does not induce lateral forces on the pipe joint during torque application (tightening or loosening).

A further object of the present invention is to provide a means of tong interconnection which eliminates lateral forces which might otherwise occur because of irregularities of the threaded members, such as, bent pipe or eccentric lead.

Yet another object of the present invention is to provide a means of tong interconnection which allows the distance between the tong bodies to shorten or lengthen during tightening, to accommodate the pipe joint becoming shorter as threads are taken up (or becoming longer as the pipe joint loosens).

Yet another object of the invention is to provide a means by which the torque being applied to the pipe joint can be directly and accurately measured.

SUMMARY OF THE INVENTION

The improved combined tong apparatus for assembling and disassembling members having mating threaded connections, according to the present invention, is characterized by a lead tong, a back-up tong, and a means for interconnecting the lead tong to the back-up tong in such a manner that no single, unpaired forces, but rather only "couples" (paired forces of equal magnitude, but opposite direction) are created by the interconnecting means; and, a load cell which cooperates, in either tong, between a pivoting, internal moment arm and the tong housing to produce a torque meansurement.

When the lead tong is operated, its driving torque tends to cause the lead tongs to rotate about the threaded member in the direction opposite to the driving torque. Since the back-up tong firmly grasps one of the threaded members, said driving torque also tends to cause the back-up tong to rotate in the same direction as the driving torque. By interconnecting the lead tong body to the back-up tong body, each tong's relative tendency to rotate about the threaded member axis, in opposite directions, counteracts the other, therefore the combined tong assembly has no relative tendency to rotate about the threaded member. Therefore, the assembly does not require extraneous means for securing it in place, such as snubbing lines.

The back-up tongs are adapted to the lead tongs by means of an interconnecting structure, torsionally rigid, but which allows three dimensional linear movement between the tongs. By being torsionally rigid, but slidable linearly, in the directions indicated, the interconnecting frame is therefore not capable (within all normal operating limits) of transferring any net lateral force vectors between the two tong bodies, but rather resolves all such force vectors to "couples" external to the threaded member. By using only "couples" (the equivalent of "pure torque") to secure each tong from rotation about the pipe axis, there is no tendency for the tongs to impose lateral forces on the pipe during tightening (or loosening).

Either tong is equipped with a pivoting torque arm which cooperates with the tong housing and a load cell to produce a torque measurement.

BRIEF DESCRIPTION OF THE DRAWINGS

FIG. 2(*b*) is a schematical isometric view of PRIOR ART combined tongs which use a single "reaction bracket" to restrain tong movement.

FIG. 2(*c*) is a schematical isometric view of PRIOR ART which uses a plurality of rigid interconnecting shafts to interconnect the lead tong and back-up tong.

DESCRIPTION OF THE PREFERRED EMBODIMENT

The present invention has three major components; a power-driven lead tong, an improved means for interconnecting a lead tong, and, a back-up tong. Either the lead tong or the back-up tong has improvements to allow for measurement of torque.

The first major component of the combined tong apparatus is a power-driven lead tong. The lead tong contains elements for gripping and rotating a first threaded member (upper pipe) in threadable alignment with a second threaded member (lower pipe).

The preferred embodiment of the present invention has power-driven lead tongs of the sort ordinarily used in the oilfield, such as those disclosed in U.S. Pat. No. 4,060,014.

The second major component of the present invention is an improved means for connecting a lead tong to a back-up tong.

Figures 1A, 1B:
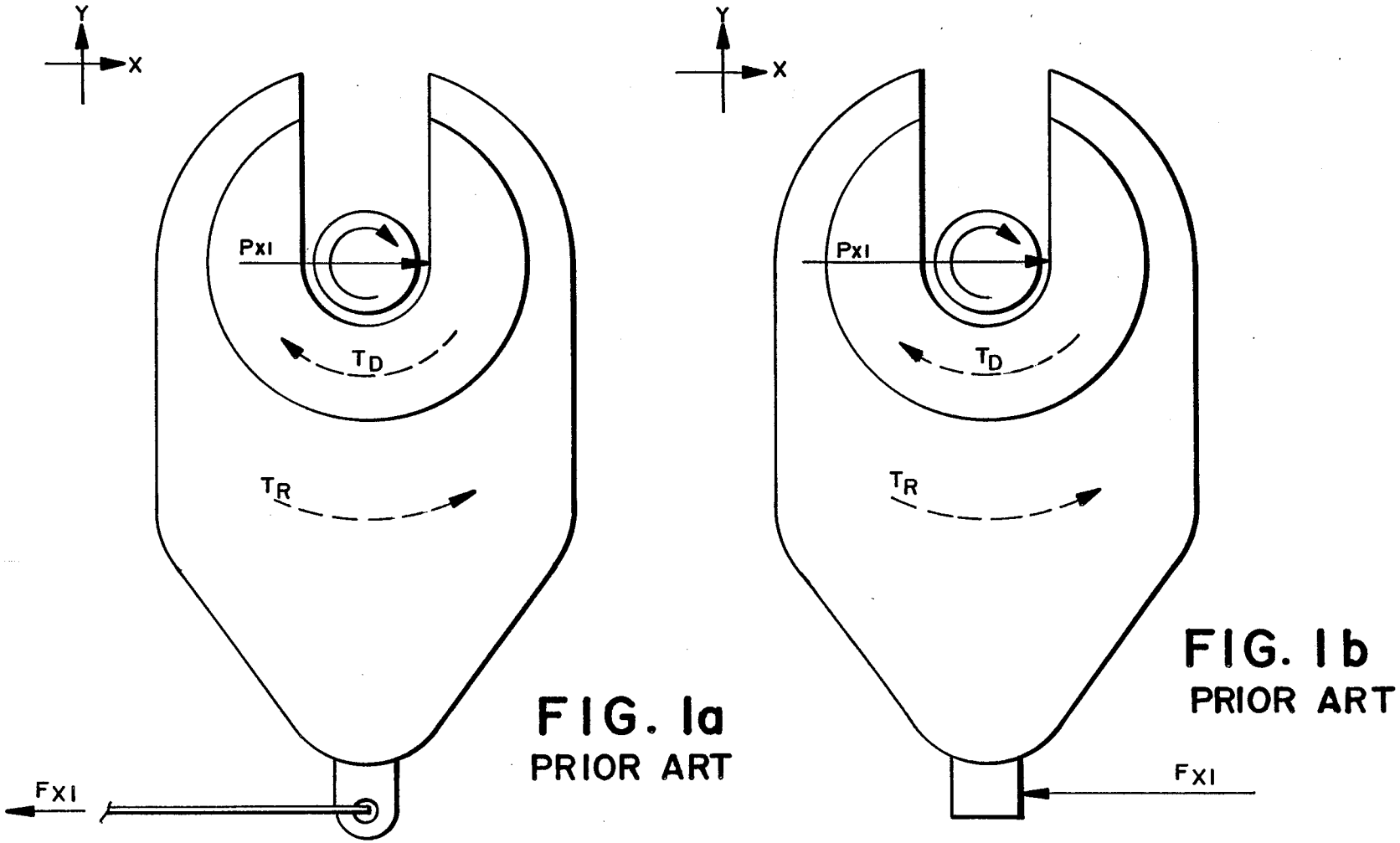
FIG. 1b PRIOR ART
FIG. 1a PRIOR ART
FIGS. 1(*a*), 1(*b*) and 1(*c*) are schematical overhead views of PRIOR ART lead tong illustrating force vectors during tightening; 1(*a*) showing the effect of a snubbing line; 1(*b*) showing the effect of a reaction bracket; and, 1(*c*) showing the effect of multiple rigid interconnects.
Figure 1C:
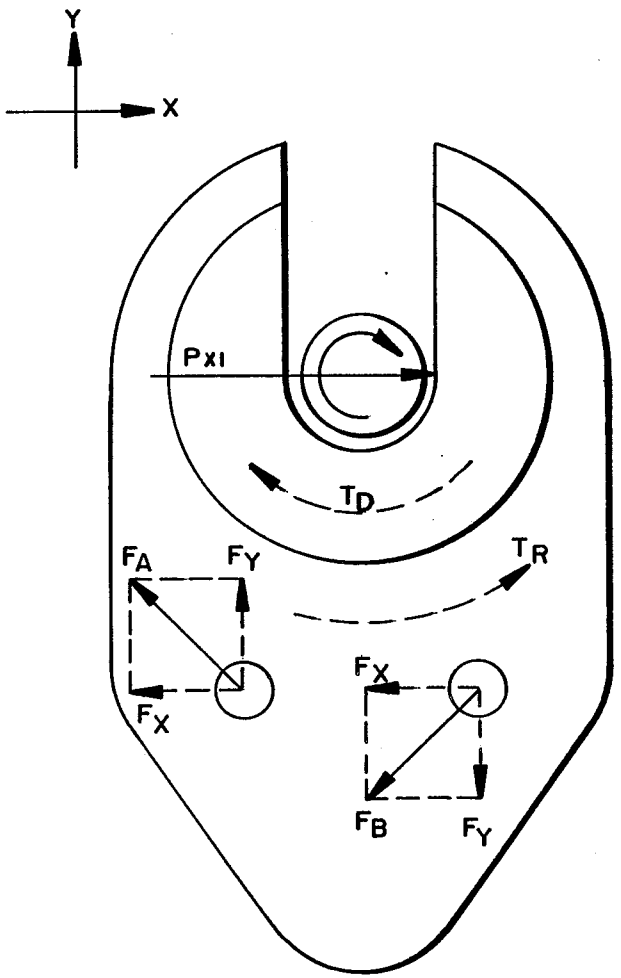
FIG. 1c PRIOR ART

With reference to FIG. 1(*a*), showing prior art, it is seen that when a lead tong is operated it produced a driving torque, $T_D$, which acts on a rotary element which is grippingly engaged to a first threaded member (upper pipe). In response to the driving torque, $T_D$, a reaction torque, $T_R$, is imposed on the tong body in the direction opposite to that of pipe rotation. The lead tong must be secured against rotation about the pipe axis, in response to $T_R$, otherwise the tong would simply rotate about the pipe rather than rotating the pipe itself.

With reference to FIGS. 1(*a*), 1(*b*) and 1(*c*), showing prior art, it is seen that conventional means for securing a lead tong against rotation in response to $T_R$, whether by a snubbing line (FIG. 1(*a*)), reaction bracket (FIG. 1(*b*)) or multiple rigid interconnects to the back-up tong (FIG. 1(*c*)) all involve lateral, linear forces, $F_x$, being imposed on the tong housing. In response to $F_x$, the tong housing tends to move laterally. Said lateral movement of the tong causes deflection of the pipe, which gives rise to $P_x$, which then counteracts $F_x$. Therefore, while both rotational and linear equilibrium of the tongs was achieved by prior art means, it was at the expense of lateral deflection of the pipe. As driving torque, $T_D$, increases; the reaction torque, $T_R$, also increases; as does the force required to secure the tong against rotation, $F_x$; and as does the force, $P_x$, which is developed by the pipe in response to lateral deflection.

Figure 2A:
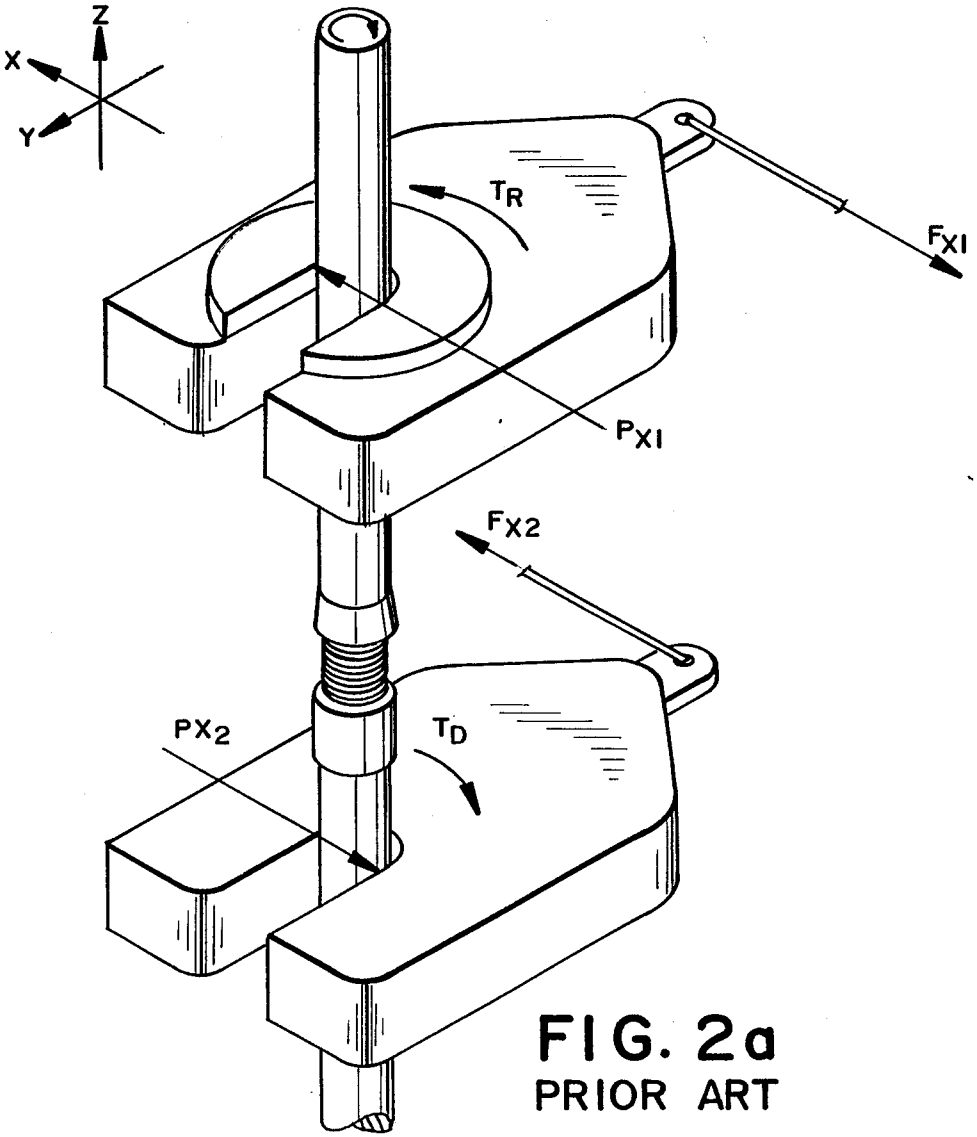
FIG. 2a PRIOR ART
FIG. 2(*a*) is a schematical isometric view of PRIOR ART combined tongs which use snubbing lines to restrain tong movement.
Figure 2C:
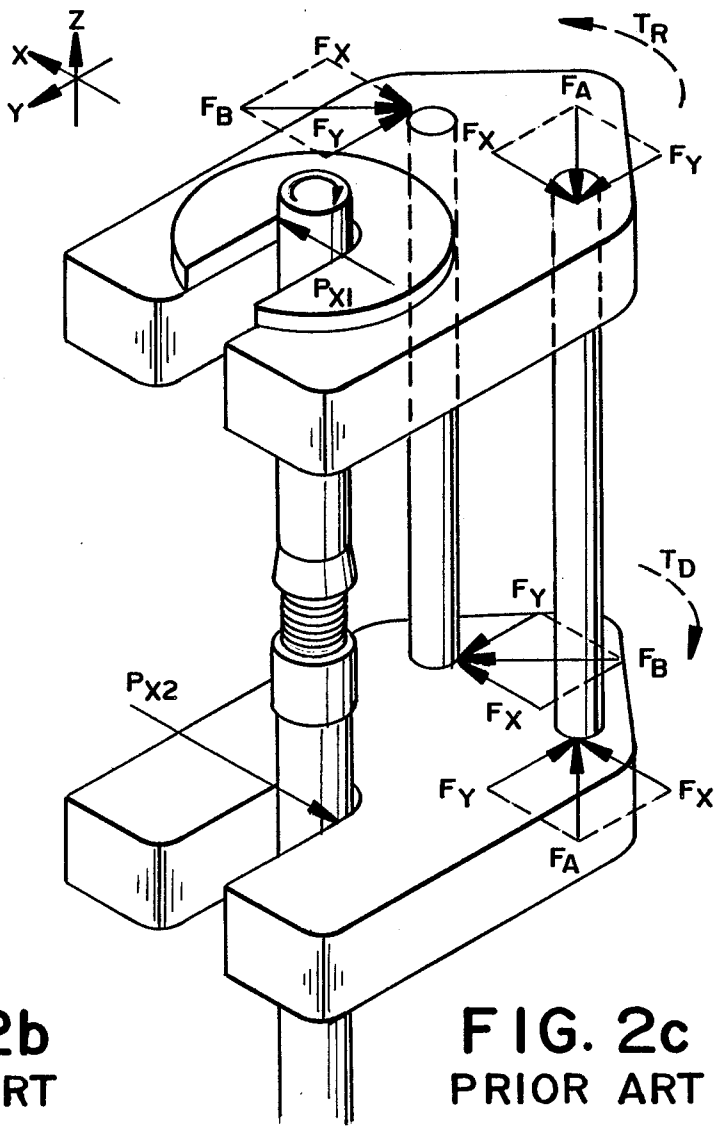
FIG. 2c PRIOR ART
Figure 2B:
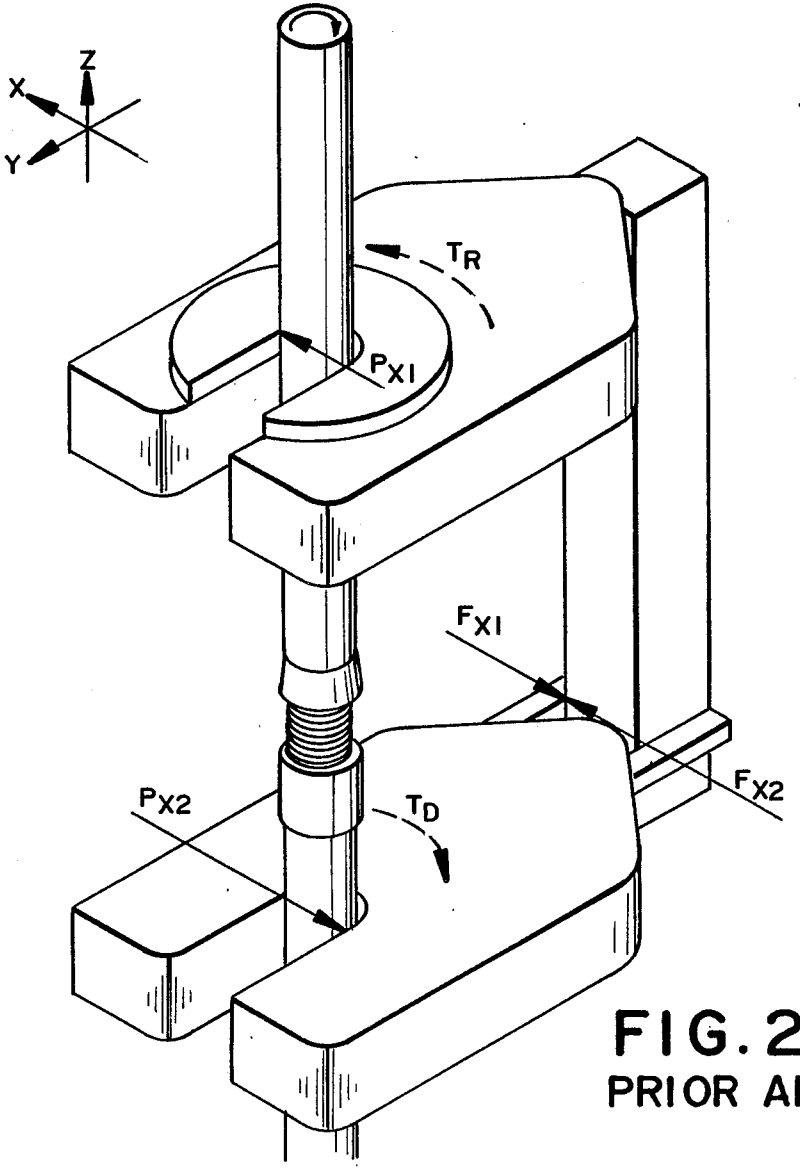
FIG. 2b PRIOR ART
Figure 3:
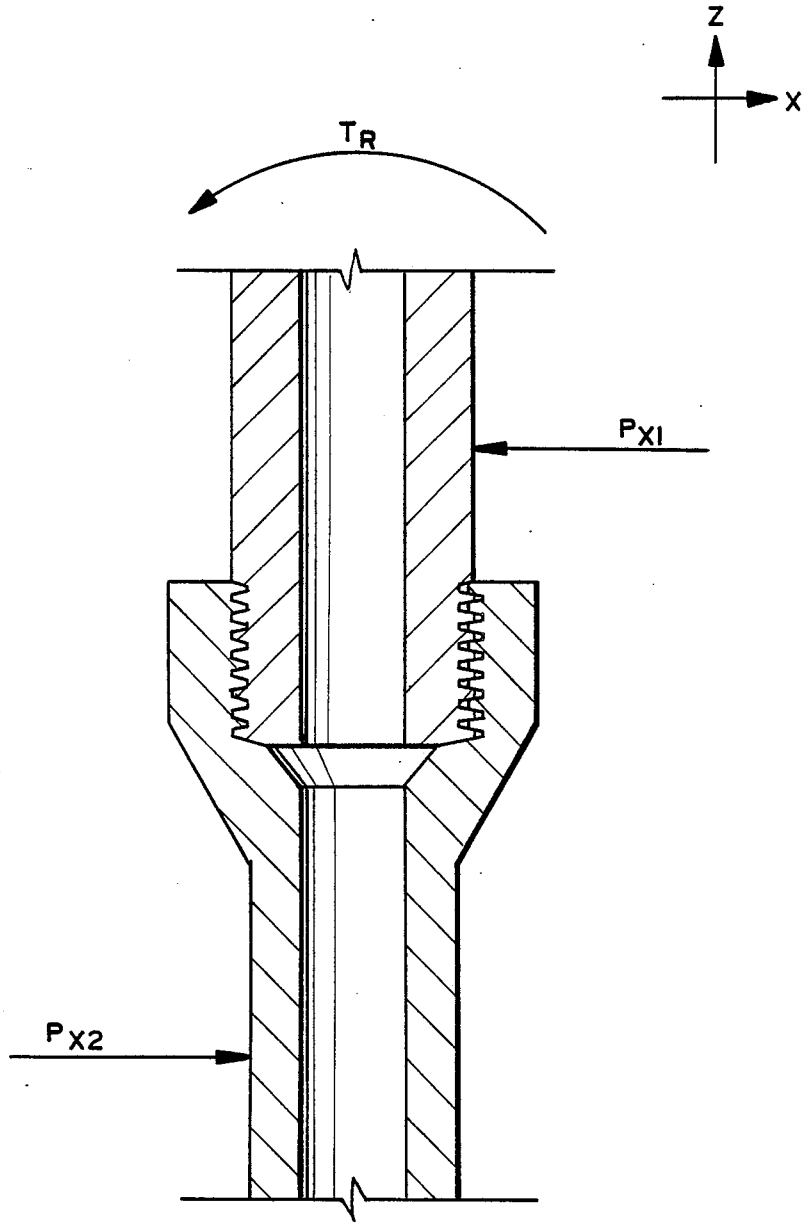
FIG. 3 is a schematical sectional view of a threaded member connection being tightened while under the influence of lateral forces.

With reference to FIGS. 2(*a*), 2(*b*) and 2(*c*), showing prior art, it is seen that a similar (but opposite direction) reaction occurs at the level of the back-up tong. The driving torque of the lead tongs, $T_D$, is transferred through the threaded members to the back-up tong which is grippingly engaged to the second threaded member (lower pipe). The back-up tongs therefore tend to rotate with the second threaded member, instead of securing the second member against rotation, unless the back-up tongs are restrained against rotary movement. One prior art means to secure a back-up tong against rotation involves use of rearwardly attached snubbing line (FIG. 1(*a*)). Other prior art means to secure a back-up tong against rotation involves use of a reaction bar (FIG. 2(*b*)) or use of multiple rigid interconnects (FIG. 2(*c*)). Said prior art means imposed linear, lateral forces, $F_x$, on the back-up tong body, which caused lateral deflection of the pipe, which gave rise to $P_x$. While rotational and linear equilibrium of the back-up tongs was achieved, again, same was achieved at the expense of lateral deflection of the pipe.

The improved interconnecting means disclosed herein eliminates the necessity of snubbing lines by making use of each tong's tendency to rotate about the pipe axis, in opposite directions, to counteract each other. The improved interconnecting means, however, avoids the imposition of any net lateral forces on the tong housings, thereby avoiding the imposition of lateral forces on the threaded members.

In the preferred embodiment of the present invention the interconnecting structure between the lead tong and back-up tong is comprised of three pairs of slides interconnected in series, each pair permitting relative movement between the lead tong and back-up tong in a certain linear direction. By connecting each pair of slides in a mutually perpendicular relationship to the other slides, an isolated torsional-transfer "joint" (a joint which will allow relative, three dimensional linear movement, but no relative rotary or angular movement) interconnects the lead tong and back-up tong. By permitting linear movement between the two tongs, in any direction, the transferral of linear forces between the two tongs is eliminated, because in order for a "force" to arise "movement" must be resisted by an equal and opposite force. However, since the isolated-torsional transfer structure is torsionally rigid, each tong is restrained from axial rotation about the workpiece by an equal torsional force created by the other tong. These torsional, pure torque and opposite, forces impose no lateral, bending or deflection loads on the workpiece being made up or broken out. In the preferred embodiment we have chosen, as a matter of convenience, to orient one pair of slides parallel to the pipe axis (called z-slide), one pair of slides parallel to a radial of the pipe extending through a point mid-way between this pair of slides (called y-slide), and the third pair of slides parallel to a line tangential to the pipe at the same mid-way point (called x-slide). Any other mutually perpendicular orientations could be selected so long as the physical structure of the ITT (isolated torsional transfer) joint does not interfere with operation of the tongs, and said joint is conveniently adaptable to the tong bodies.

The slide parallel to the pipe axis (called Z-slide) allows the distance between the tong bodies to increase or decrease as the pipe joint loosens or tightens. The Z-slide also cooperates with the lateral slides (called the x-slide and y-slide, respectively) to produce couples (paired forces of equal magnitude but opposite direction) to prevent relative rotational movement (torsional rigidity) between the tong housings.

The lateral slides permit relative linear movement in any direction in the lateral plane. The relative linear movement allowed prevents any net linear force from arising in the lateral plane (no force may arise unless something resists it). Conversely by virtue of the fact that each slide is connected to the adjacent structure (whether tong housing or adjacent slide) at more than one point, the lateral slides permit the transfer of paired forces (couples) between the tong housings, thereby providing torsional rigidity between said housings. By use of only couples (the equivalent of pure torque) to secure each tong against rotation about the threaded members, no lateral forces are imposed on the threaded member, and the connection is made by essentially pure torque.

While there may be many embodiments of the improved interconnecting means, with reference to FIG. 4, and FIG. 6 one embodiment is described below. Two cylindrical guides 1 are vertically adapted to the lead tong (FIG. 6) by means of adapting plates 2. Shafts 3 are slidably disposed within the cylindrical guides 2. The cylindrical guides 2 and shafts 3 slidably cooperate along the Z-axis, and are called the Z-slide. The lower part of shafts 3 slidingly cooperate (along the X-axis) with horizontal shafts 4. Horizontal shafts 4 are mounted to plate 5 by means of offset blocks 6, and are collectively called the X-slide. Plate 5 is adapted to tubes 7, which slidably cooperate (along the Y-axis) with horizontal shafts 8 (called the Y-slide). Horizontal shafts 8 are mounted to the back-up tong (not shown) by means of offset blocks 9.

Figure 4:
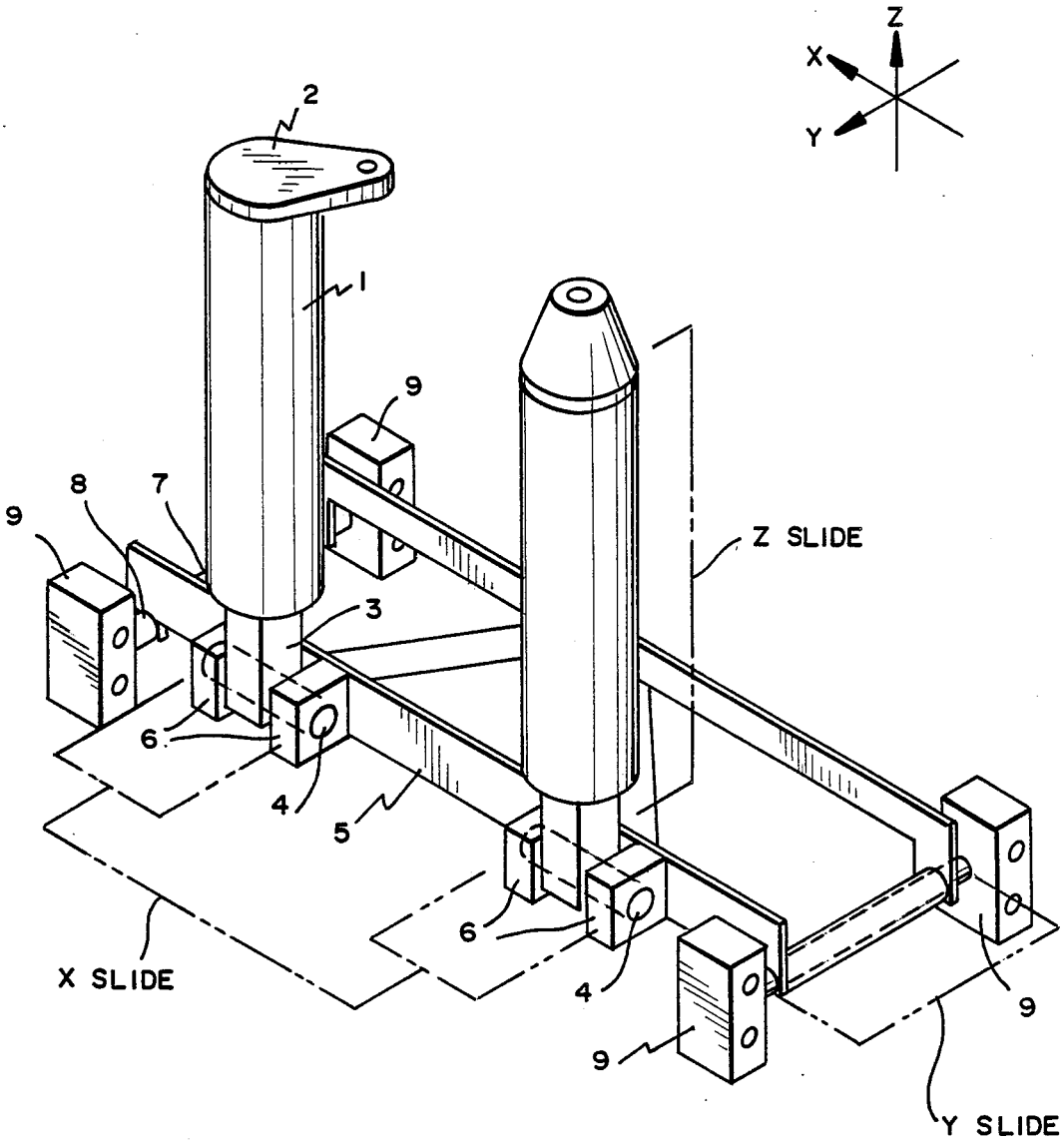
FIG. 4 is a isometric view of the interconnecting frame (without attached tongs) of the preferred embodiment of the present invention.
Figure 5:
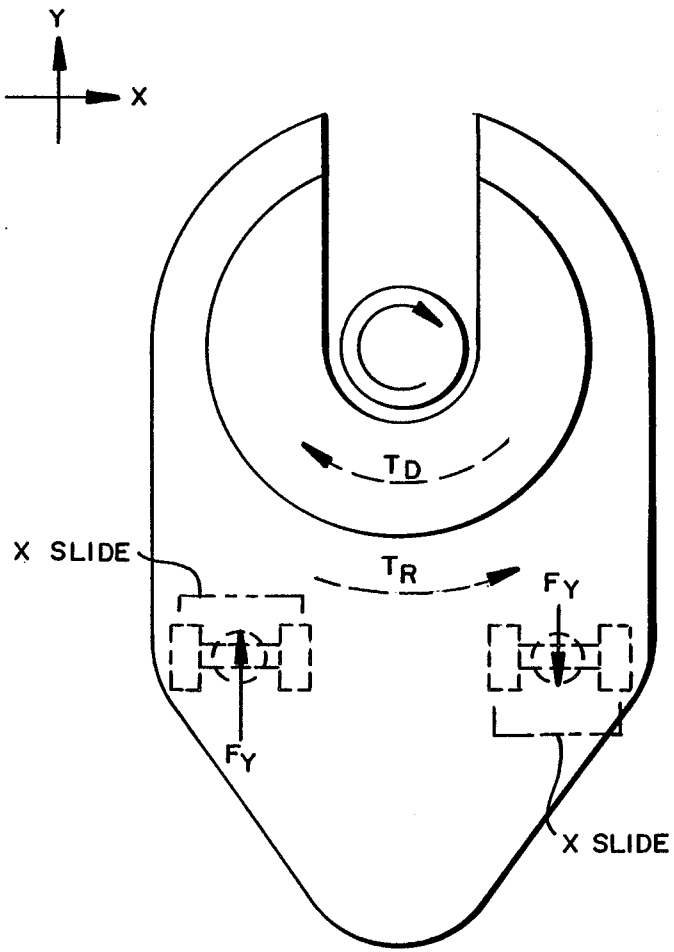
FIG. 5 is a schematical overhead view of the lead tongs of the present invention showing force vectors on the X-slide.

FIG. 5 is a schematical overhead view of the lead tong diagraming the force vectors imposed on the lead tong, by the X-slide of the aforesaid particular embodiment of FIG. 4. Since the tongs are slidable relative to each other in the X-direction, no relative forces may be transferred between the tongs in that direction. Reaction torque of the lead tongs, $T_R$, is counteracted by a couple whose component forces, $F_y$, are perpendicular to the X-slide.

Figure 6:
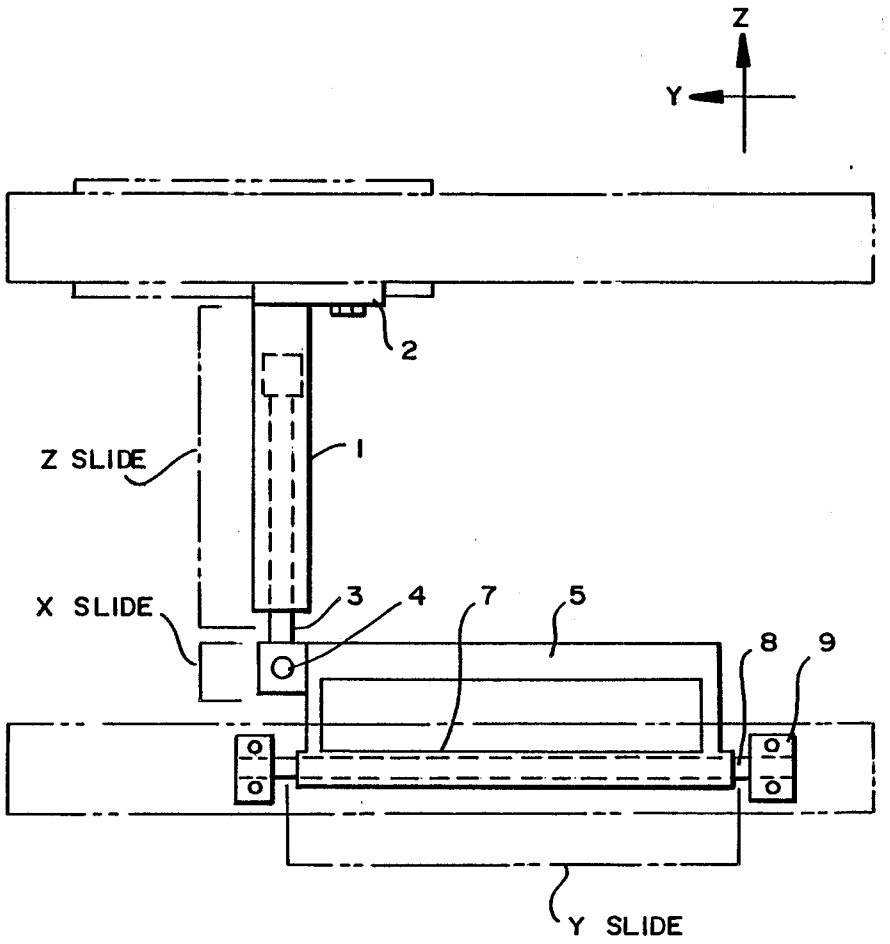
FIG. 6 is a side elevational view of the apparatus of FIG. 4.

FIG. 6 is a schematical side elevation view of the particular embodiment of FIG. 4, showing orientation of the X, Y and Z slides.

Figures 7, 8:
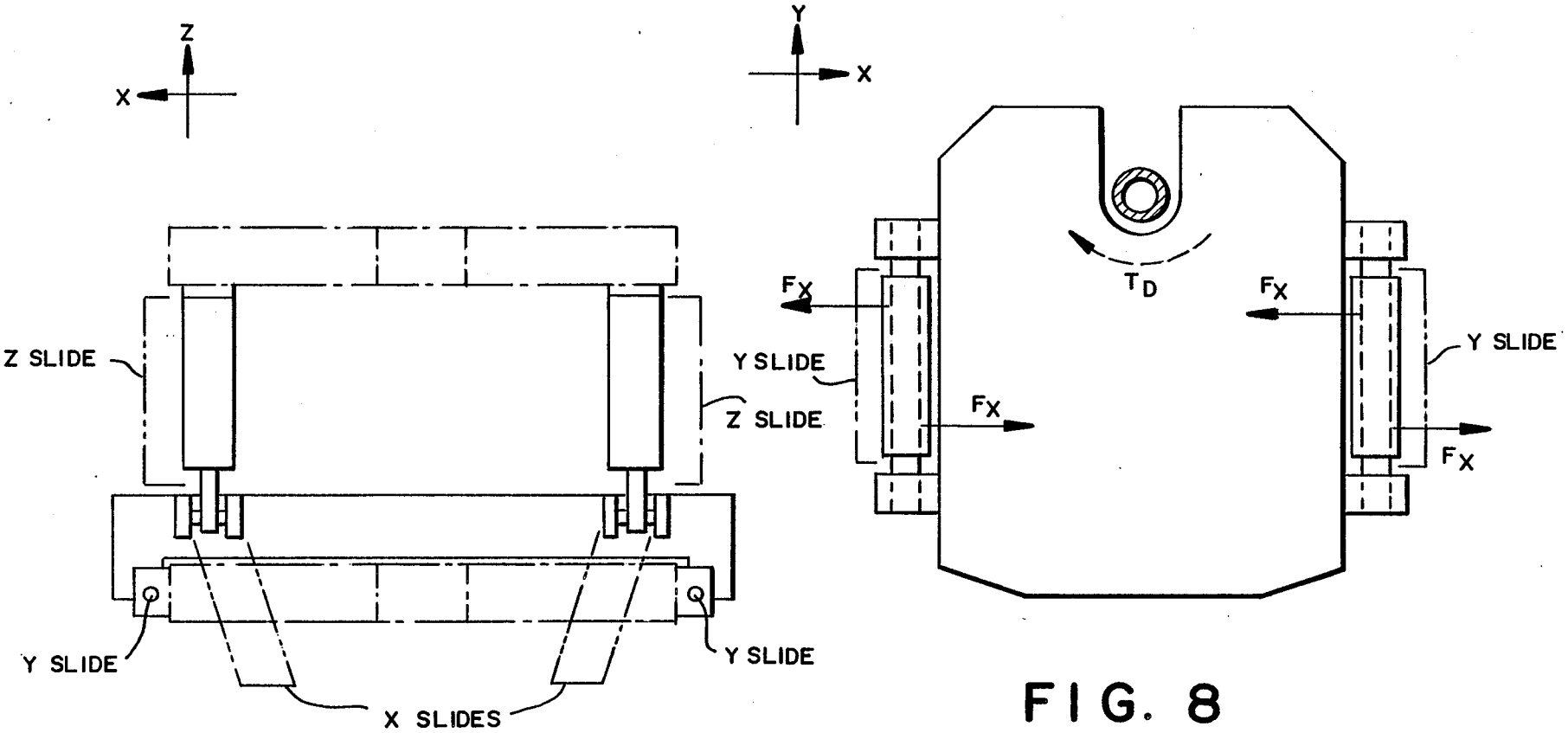
FIG. 7 is an end elevational view of the apparatus of FIG. 4.
FIG. 8 is a schematical overhead view of the back-up tongs of the present invention, showing the force vectors on the Y-slide.

FIG. 7 is a schematical front elevation view of the particular embodiment of FIG. 4, showing orientation of the X, Y and Z slides.

FIG. 8 is a schematical overhead view of the back-up tongs diagraming the force vectors on the back-up tong, by the X-slide of the embodiment of FIG. 4. The driving torque, $T_D$, imposed on the back-up tong through the threaded members, is counteracted by paired forces, $F_x$, imposed on the Y-slide perpendicularly.

Accordingly the driving torque, $T_D$ (imposed on the back-up tong) and the reaction torque, $T_R$ (imposed on the lead tong) are made to counteract each other through paired interconnected slides which provide torsional, but not linear rigidity. Consequently each tong is secured from rotating about the pipe by paired forces (couples) only, and no lateral, linear forces exist between the tong housings. By eliminating unpaired lateral, linear forces between the tong housings, no such forces are imposed on the pipe.

The third major component of the invention is a back-up tong. The back-up tong secures the second threaded member (lower pipe) from rotation in response to rotation of the first threaded member (upper pipe) threadably engaged therewith. An improved back-up tong is provided to allow a means, internal to the back-up tong, to produce a torque measurement. Prior art means for producing a torque measurement involved use of a load cell to measure the lateral forces imposed on one tong (for example, by use of a load cell in a snubbing line) or between the two tongs (for example, by use of a load cell cooperating with a reaction bracket). Because the improved interconnecting means eliminates all lateral forces, other means for producing a torque measurement are provided.

Figure 9:
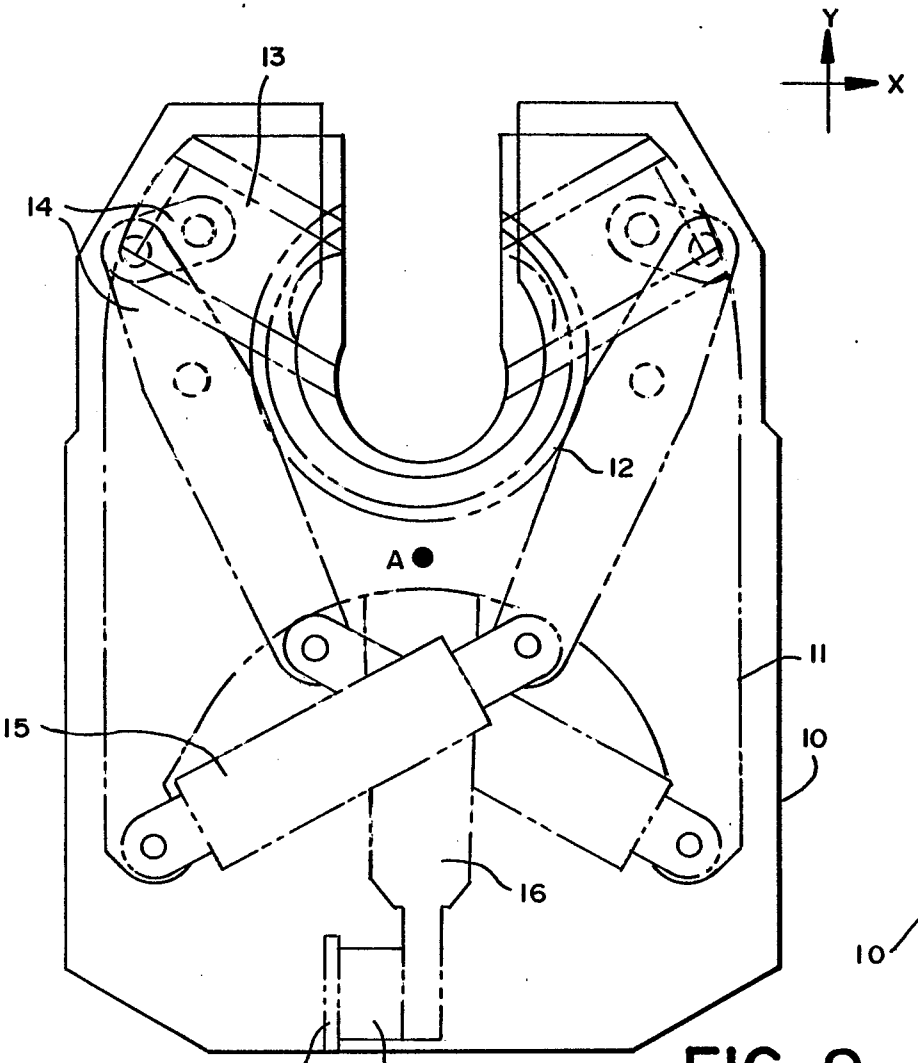
FIG. 9 is an overhead plan view of the back-up tong of the preferred embodiment of the present invention.

With reference to FIG. 9, the back-up tong of the preferred embodiment has an external housing 10, which pivotally cooperates with inner frame 11, through radial bearing 12. In the preferred embodiment radial bearing 12 is simply a circular groove and ridge arrangement which has its center coincident with the axis of the workpiece. Alternatively, the external housing 10, can be made to pivotally cooperate with the inner frame 11 by any other conventional means, such as a pin and bushing arrangement, at any convenient point which is not coincident with the pipe axis, such as point A of FIG. 9. In the event a point not coincident with the pipe axis is chosen for pivotal engagement of the external housing 10, and inner frame 11, the load cell 17 will have a different calibration factor.

With further reference to FIG. 9, the gripping elements of the back-up tong; being dies 13, levers 14 and cylinders 15 are mounted to inner frame 11, and are the same as those found in conventional back-up tongs.

Further referring to FIG. 9, the preferred embodiment of the present invention has a moment arm 16, which is rigidly affixed to the inner frame 11 by conventional means. Rigidly affixed to the external housing 10 is plate 18. Load cell 17 cooperates between moment arm 16 and plate 18 to produce a torque reading.

Figure 10:
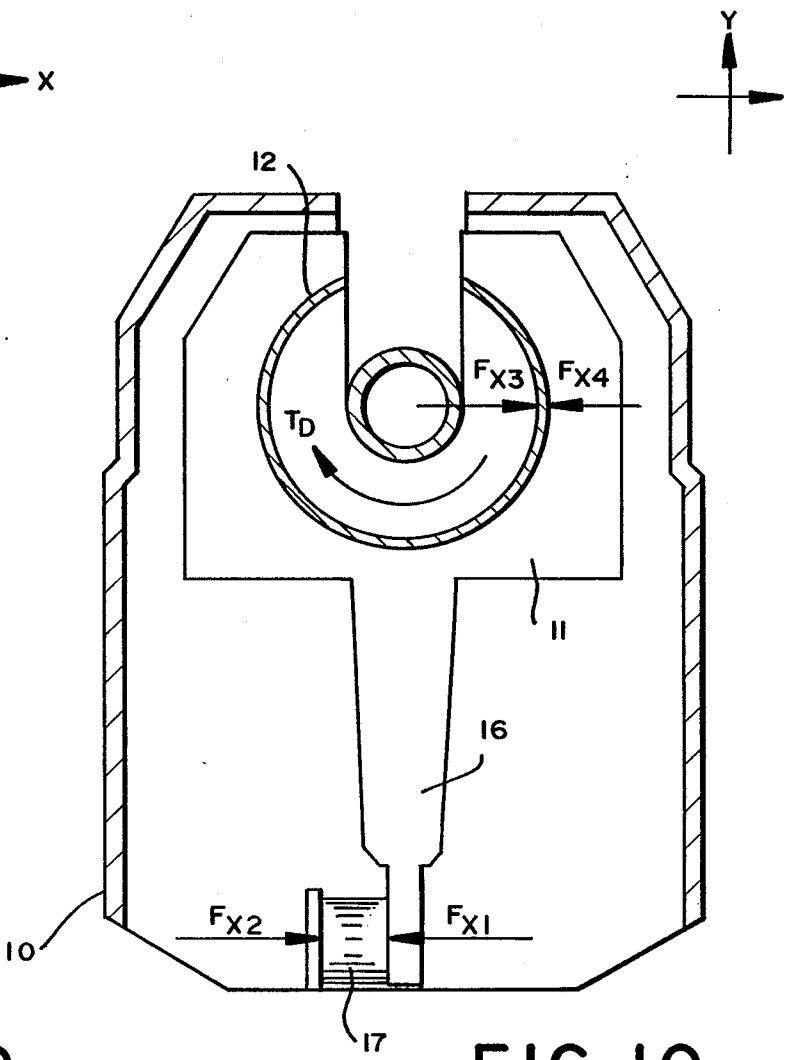
FIG. 10 is a schematical view of the back-up tong of the present invention, showing the force vectors on the radial bearing load cell and moment arm.

FIG. 10 is a schematical overhead view of the improved back-up tong of the present invention for purpose of illustrating the force vectors created in the back-up tong during operation. The pipe is grippingly engaged by the moment arm/inner/frame/die assembly. As the lead tong rotates the upper piece of pipe, clockwise in this example, a clockwise torque, $T_D$, is applied to the lower pipe. Consequently torque $T_D$ is also applied to the moment arm/inner frame/die assembly grippingly engaged with the lower pipe. Torque $T_D$ tends to produce angular rotation of the moment arm-/inner frame/die assembly, but said rotation is resisted by the loadcell. In turn loadcell movement is resisted by the plate affixed to the external housing. The forces generated by the loadcell resisting angular rotation of the moment arm/inner frame/die assembly, $Fx_1$ and $Fx_2$, are tansferred through the moment arm/inner frame/die assembly and the external housing and give rise to forces $Fx_3$ and $Fx_4$ of equal magnitude, but opposite direction, at the radial bearing (or at such other pivot point which may have been chosen). $Fx_1$ and $Fx_3$ constitute a "couple" (paired forces of equal magnitude but opposite direction) as do $Fx_2$ and $Fx_4$, hence the net effect of all forces is two opposing pure torque forces, without any net linear forces vectors which would impose a lateral or bending force on the pipe.

Another embodiment of the improved back-up tongs, not shown, would be to eliminate the radial bearing but provide another point (not coincident with the pipe axis), through which the outer housing and inner frame would pivotally interact.

Another embodiment of the present invention (not shown) would be to use an ordinary lead tong and ordinary back-up tong and obtain a torque measurement by indirect means such as measuring hydraulic pressure acting on the lead tong motor.

Another embodiment of the present invention (not shown) would be an ordinary back-up tong, but an improved lead tong to produce a torque measurement. Said improved lead tongs would be similar to the back-up tongs described fully herein, that is, the lead tong would have an outer housing pivotally engaged with an inner frame at or near a point coincident with the pipe axis, the gripping and rotating elements, as well as a moment arm, being disposed on the inner frame, which moment arm would cooperate with the outer housing, through a load cell, to produce a torque measurement.

Many other embodiments of the present invention are possible, without departing from the spirit and intent of the invention.

What is claimed is:

1. A combined tong apparatus for making-up or breaking-out of threaded member workpieces, comprising:

(a) a lead tong for rotatably driving a first threaded member workpiece in threadable alignment with a second threaded member workpiece;

(b) an improved back-up tong for securing said second threaded member workpiece against axial rotation in response to rotation of said first threaded member workpiece, and for producing a torque measurement, said improved back-up tong comprising an external housing, an inner frame pivotally engaged with the external housing about a point coincident with the axis of the threaded member workpiece, means adapted to said inner frame for gripping said second threaded member workpiece, and a loadcell which cooperates between said external housing and said inner frame to produce a torque measurement; and, (c) improved means for connecting said lead tong and said back-up tong comprising a structural means which permits three dimensional linear, slidable relative movement between said tongs but which does not allow relative rotary movement between said tongs.

2. A combined tong apparatus for making-up or breaking-out of threaded member workpieces having mating threaded connections comprising:

(a) a lead tong for rotatably driving a first threaded member workpiece in threadable alignment with a second threaded member workpiece;

(b) an improved back-up tong for securing said second threaded member workpiece against axial rotation in response to rotation of said first threaded member workpiece, and for producing a torque measurement, said improved back-up tong comprising an external housing, an inner frame pivotally engaged with the external housing about a point coincident with the axis of the threaded member workpiece, means adapted to said inner frame for gripping said second threaded member workpiece, and a loadcell which cooperates between said external housing and said inner frame to produce a torque measurement; and, (c) an improved isolated torsional-transfer means disposed between and adapted to said lead tong and said back-up tong, for securing said lead tong and said back-up tong against relative rotary movement about the threaded member workpieces without applying any linear, bending forces to the threaded member workpieces, said isolated torsional transfer means comprising a plurality of pairs of slides interconnected series, in three mutually perpendicular directions so as to allow relative linear three dimensional movement between the tongs.

3. The apparatus of claim 2, wherein said isolated torsional transfer means comprises a plurality of interconnected slides which are disposed in three mutually perpendicular directions, the first direction being parallel to the axis of the threaded member workpieces, the second direction being toward and away from the axis of the threaded member workpiece, and the third direction being perpendicular to both the first and second directions.

4. The apparatus of claim 3, wherein said means for connecting said lead tong and said back-up tong comprises two vertical cylinders adapted to the bottom of the lead tong at points equidistant from the axis threaded member workpiece, two vertical shafts slidably disposed within said cylinders, the lower end of said vertical shafts being slidably adapted to a pair of first horizontal shafts which are disposed parallel to a line between said vertical shafts, said first horizontal shafts being adapted to a carriage plate, said carriage plate being slidably adapted to a pair of second horizontal shafts which are disposed perpendicularly to a line between said vertical shafts, said second horizontal shafts being adapted to the back-up tong.

5. The apparatus of claim 1, wherein said external housing of the back-up tong and inner frame of the back-up tong are pivotally engaged at a point which is not coincident with the axis of the threaded member workpiece.

6. The apparatus of claim 2, wherein said external housing of the back-up tong and inner frame back-up tong are pivotally engaged at a point which is not coincident with the axis of the threaded member workpiece.

7. The apparatus of claim 3, wherein said external housing of the back-up tong and inner frame of the back-up tong are pivotally engaged at a point which is not coincident with the axis of the threaded member workpiece.

8. The apparatus of claim 4, wherein said external housing of the back-up tong and inner frame of the back-up tong are pivotally engaged at a point which is not coincident with the axis of the threaded member workpiece.

9. A combined tong apparatus for making-up and breaking-out of members having mated threaded connections comprising:

(a) an improved lead tong for rotatably driving a first threaded member in threadable alignment with a second threaded member and for producing a torque measurement, said improved lead tong comprising an external housing, an inner frame pivotally engaged in the external housing about a point coincident with the axis of the threaded member workpiece, means adapted to said inner frame for gripping and rotating a threaded member workpiece, and a loadcell which cooperates between said external housing and said inner frame to produce a torque measurement; and, (b) a back-up tong for securing a second threaded member against rotation in response to rotation of a first threaded member threadably engaged therewith; and, (c) improved means for connecting said lead tong and said back-up tong comprising a structural means which permits three dimensional linear, slidable relative movement between said tongs but which does not allow relative rotary movement between said tongs.

10. The apparatus of claim 9, wherein said means for connecting said lead tong and said back-up tong are disposed in three mutually perpendicular directions, the first direction being parallel to the axis of the threaded member workpiece, the second direction being toward and away from the axis of the threaded member workpiece and the third direction being perpendicular to both the first and second directions.

11. The apparatus of claim 9, wherein said means for connecting said lead tong and said back-up tong comprises two vertical cylinders adapted to the bottom of the lead tong, two vertical shafts slidably disposed within said cylinders, the lower end of said vertical shafts being slidably adapted to a pair of first horizontal shafts which are disposed parallel to a line between said vertical shafts, said first horizontal shafts being adapted to a carriage plate, said carriage plate being slidably adapted to a pair of second horizontal shafts which are disposed perpendicular to a line between said vertical shafts, said second horizontal shafts being adapted to the back-up tong.

12. The apparatus of claim 9, wherein said external housing of the lead tong and said inner frame of the lead tong are pivotally engaged at a point which is not coincident with the axis of the threaded member workpiece.

13. The apparatus of claim 10, wherein said external housing of the lead tong and said inner frame of the lead tong are pivotally engaged at a point which is not coincident with the axis of the threaded member workpiece.

14. The apparatus of claim 11, wherein said external housing of the lead tong and said inner frame of the lead tong are pivotally engaged at a point which is not coincident with the axis of the threaded member workpiece.

15. A combined tong apparatus for making-up and breaking-out of members having mating threaded connections comprising:

(a) a lead tong for rotatably driving a first threaded member workpiece in threadable alignment with a second threaded member workpiece;

(b) a back-up tong for securing a second threaded member against rotation in response to rotation of a first threaded member threadably engaged therewith; and, (c) improved means for connecting said lead tong and said back-up tong comprising a structural means which permits three dimensional linear, slidable relative movement between said tongs but which does not allow relative rotary movement between said tongs.

16. The apparatus of claim 15, wherein said means for connecting said lead tong and said back-up tong are disposed in three mutually perpendicular directions, the first direction being parallel to the axis of the axis of the threaded member workpieces, the second direction being toward and away from the axis of the threaded member workpiece and the third direction being perpendicular to both the first and second directions.

17. The apparatus of claim 15, wherein side interconnecting means comprises two vertical cylinders adapted to the bottom of the lead tong, two vertical shafts slidably disposed within said cylinders, the lower end of said vertical shafts being slidably adapted to a pair of first horizontal shafts which are disposed parallel to a line between said vertical shafts, said first horizontal shafts being adapted to a carriage plate, said carriage plate being slidably adapted to a pair of second horizontal shafts which are disposed perpendicular to a line between said vertical shafts, said second horizontal shafts being adapted to the back-up tong.

* * * * *